US005094131A

United States Patent [19]

Sorensen et al.

[11] Patent Number: 5,094,131

[45] Date of Patent: * Mar. 10, 1992

[54] HAND TOOL OR IMPROVED BAR CLAMP

[75] Inventors: Joseph A. Sorensen; Dwight L. Gatzemeyer, both of Lincoln, Nebr.

[73] Assignee: Petersen Manufacturing Co., Inc., DeWitt, Nebr.

[ * ] Notice: The portion of the term of this patent subsequent to May 22, 2007 has been disclaimed.

[21] Appl. No.: 639,797

[22] Filed: Jan. 10, 1991

Related U.S. Application Data

[63] Continuation-in-part of Ser. No. 480,098, Feb. 14, 1990, Pat. No. 5,005,449.

[51] Int. Cl.[5] ..... B25B 13/12

[52] U.S. Cl. ..... 81/152; 81/182; 81/487; 269/169

[58] Field of Search ..... 81/150, 152, 182, 373, 81/487; 269/6, 166-170, 900

[56] References Cited

U.S. PATENT DOCUMENTS

| | | | |
|---|---|---|---|
| 753,837 | 3/1904 | Barcus | 81/152 |
| 1,739,488 | 12/1929 | Thayer | 289/166 X |
| 2,149,541 | 3/1939 | Nagle | 81/182 X |
| 3,096,975 | 7/1963 | Irwin | 269/169 |
| 4,563,921 | 1/1986 | Wallace | 81/373 |
| 4,647,027 | 3/1987 | Shafto | 269/900 X |
| 4,867,427 | 9/1989 | Cunningham | 269/900 X |
| 4,901,990 | 2/1990 | Frechette | 269/900 X |
| 4,926,722 | 5/1990 | Surensen et al. | 269/166 X |
| 4,932,638 | 6/1990 | Chen | 269/6 |

*Primary Examiner*—James G. Smith

*Attorney, Agent, or Firm*—Lackenbach Siegel Marzullo & Aronson

[57] ABSTRACT

A bar clamp having a fixed jas and a movable jaw which is radially movable over both short and long distances to clamp against a workpiece and is operable using one hand with complete control by the operator at all times. The jaws may either face one another while being mounted on the same dise of a handle/grip assembly or face in opposite directions while being mounted on opposite sides of the handle/grip assembly whereby they may be incrementally advanced by the trigger handle/driving lever. Another embodiment uses a substrate comprising a plurality of apertures to receive posts thus acting as a vise type of clamp/wrench.

11 Claims, 14 Drawing Sheets

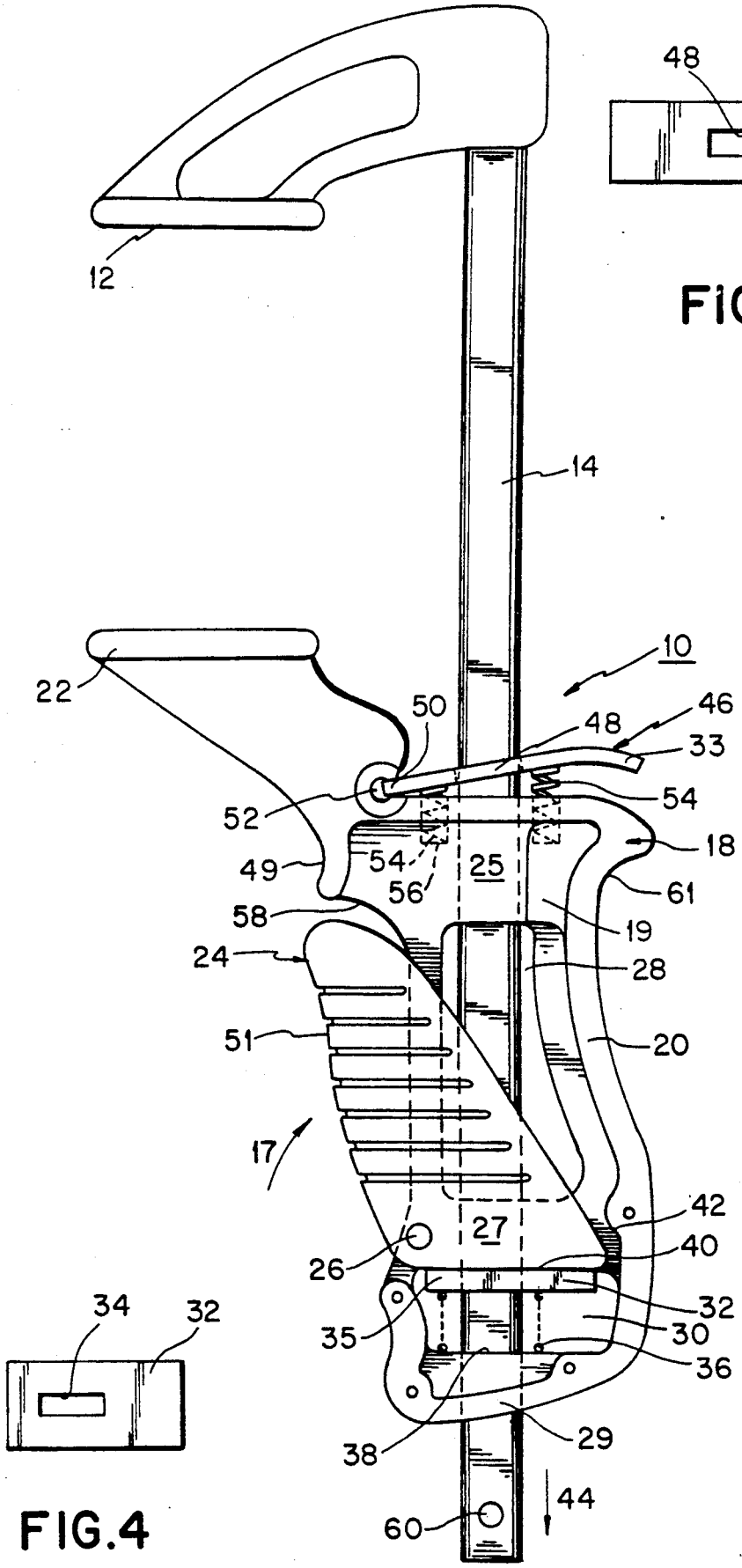
FIG. 1
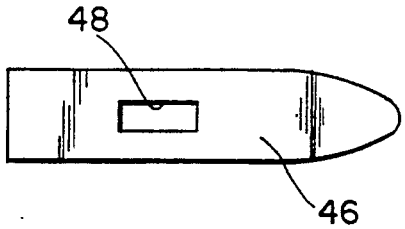
FIG. 3
FIG. 4

HAND TOOL OR IMPROVED BAR CLAMP

This application is a CIP of U.S. Pat. No. 07/480.098, filed on Feb. 14, 1990, now U.S. Pat. No. 5,005,449.

BACKGROUND OF THE INVENTION

This invention relates generally to a hand tool or a bar clamp of the type used to temporarily clamp together two articles, for example, for gluing, or to hold a workpiece for welding, and more particularly to a quick-action bar clamp wherein the moving jaw can be rapidly advanced or advances in small increments of selectable length.

Alternatively, the hand tool of the invention can be used as a spreader to spread apart elements of the same article or two separate articles. Rapid advancement of the movable jaw and firm grip makes it possible to use the hand tool as a wrench or a cutter.

In recent years, over-center toggle action handgrips have been incorporated for use in final tightening against the workpiece, for example, in U.S. Pat. Nos. 4,088,313 by Pearson and 4,563,921 by Wallace. A disadvantage in the prior art lies in the fact that adjustment in the moving jaw is cumbersome and imprecise. Frequently, the moving jaw is entirely disengaged and free to move until the final tightening of an object between the movable and fixed jaws is accomplished.

What is needed is a versatile hand tool having a moving jaw which is rapidly movable over distances to engage a workpiece and is operable using one hand with complete control by the operator at all times.

BRIEF DESCRIPTION OF THE DRAWINGS

Other advantages and features of the invention are described with reference to exemplary embodiments, which are intended to explain and not to limit the invention, and are illustrated in the drawings in which:

FIG. 1 is an elevational view of a hand tool;

FIG. 3 is a plan view of the braking lever shown in FIG. 1;

FIG. 4 is a plan view of the driving lever;

DESCRIPTION OF ILLUSTRATIVE EMBODIMENT

Although a specific embodiment of the invention will now be described with reference to the drawings, it should be understood that the embodiment shown is by way of example only and merely illustrative of but one of the many possible specific embodiments which can represent applications of the principles of the invention. Various changes and modifications, obvious to one skilled in the art to which the invention pertains are deemed to be within the spirit, scope and contemplation of the invention as further defined in the appended claims.

Figure 2:
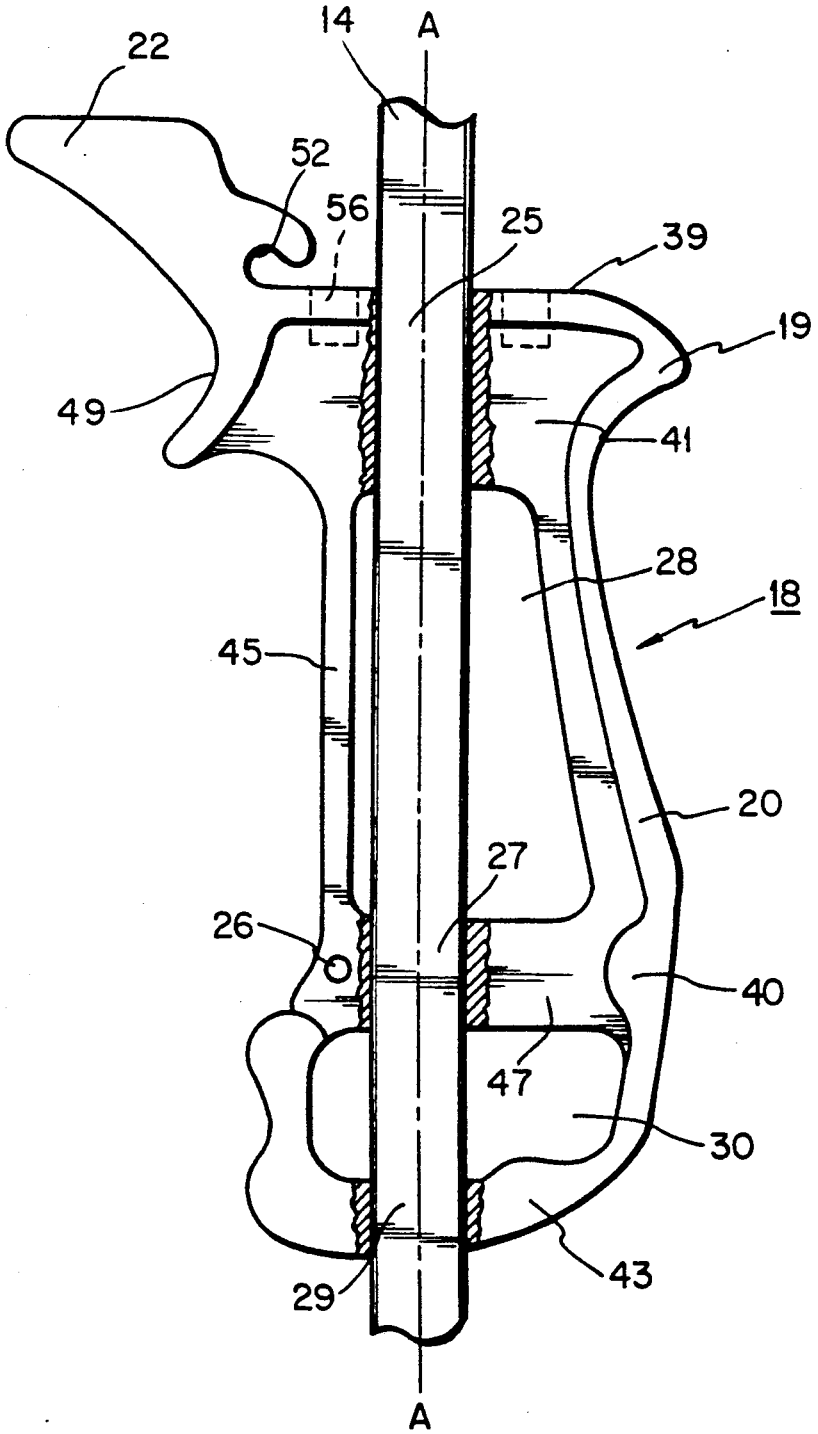
FIG. 2 is a partially sectional view of a support assembly.

Referring now to FIGS. 1 and 2, the hand tool or improved bar clamp of the invention is shown at 10 and includes a movable jaw 12 mounted to a slide bar 14. The slide bar is movable within openings 25, 27 and 29 of a support assembly or support means 18. A fixed jaw 22 opposing the movable jaw 12 extends outwardly from the support assembly.

The support assembly 18 which is more specifically shown in FIG. 2 has a body 19 with front 41 and rear 43 portions.

On one side, the front and rear portions are interconnected by a handgrip 20 which extends along a longitudinal axis A—A of the support assembly and the slide bar. Spaced from the handgrip is a first support element 45 interconnecting the other side of the front 41 and rear 43 portions. As shown in FIG. 2, the first support element 45 is substantially parallel to the longitudinal axis of the support assembly. However, other positions of the first support element are possible. An intermediate portion 47 is spaced between the front and rear portions and extends transversely to the handgrip and the first support element. The openings 25, 27 and 29 are situated correspondingly within the front, intermediate and rear portions.

FIGS. 1 and 2 illustrate that the longitudinal axis A—A of the slide bar is substantially parallel and/or coincides with the longitudinal axes of the openings 25, 27 and 29. In the support assembly 18 the slide bar is positioned between the handgrip 20 and the first support element 45. The motion of the slide bar is supported by the surfaces of the three openings, in the front, rear and intermediate portions of the support assembly. Such multiple support of the slide bar greatly enhances stability of the clamping operation. If desired, additional support of the sliding bar can be provided by making first cavity 28 solid except an opening adapted to receive the slide bar in the same manner as openings 25 and 27. In fact, with such a construction, the openings 25 and 27 would in reality be one long opening.

A trigger handle 24 is pivotably mounted to the support assembly 18 by means of a pivot pin or connection 26. For illustrative purposes this pivotal connection is shown to be positioned in the vicinity of the intermediate member 47. However, any suitable location of the pivotal connection is within the scope of the invention.

As a result of pivotal motion, at least a part of the trigger handle 24 extends into a first cavity 28 of the support assembly. This first cavity is limited by the handgrip 20, the front portion 41 and the intermediate portion 47. A second cavity 30 is situated between the handgrip 20, the intermediate 47 and rear 43 portions.

A driving lever 32 is located and/or suspended on the slide bar 14 which passes through a hole 34 in the driving lever 32. A compression spring between the driving lever 32 and a surface 38 of the cavity 30 urges the driving lever 32 against the rear end 40 of the trigger handle 24. At least the rear end 40 of the trigger handle 24 is suitably in the form of a fork so as to straddle the intermediate member 47 and the slide bar 14. Force of the spring 36 urges the trigger handle 24 against a limit stop 42 on an inner surface of the body 19 thus providing a standby condition. In the standby condition, the driving lever 32 is positioned substantially perpendicular to the direction of motion, indicated by the arrow 44, of the slide bar 14 when in operation. Motion of the trigger handle 24 about the pivot pin 26 in the direction of an arrow 17 moves the slide bar 14 against the bias of the spring 36 through the driving lever 32.

Figure 10:
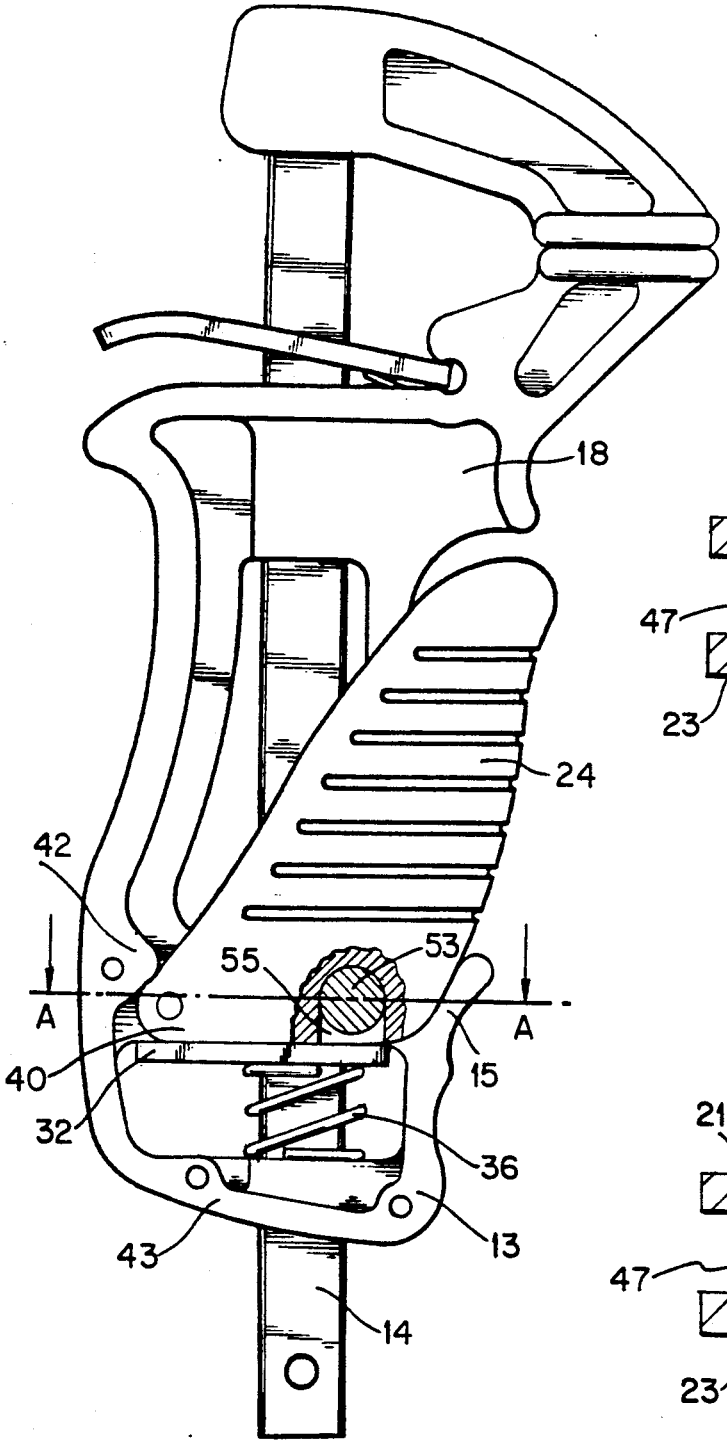
FIG. 10 is an elevational view of a modified embodiment of the hand tool.
Figure 11:
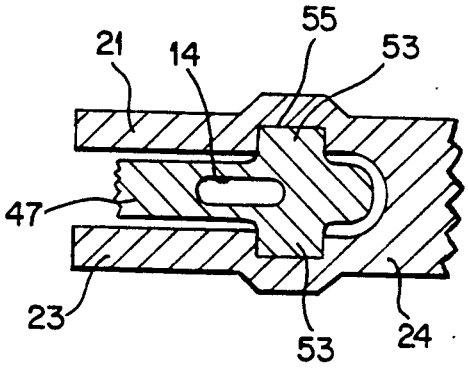
FIG. 11 is a cross-sectional view according to sectional line A—A of FIG. 10.
Figure 12:
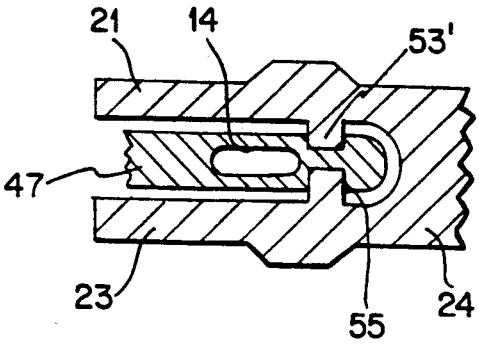
FIG. 12 is a partial cross-sectional view of a further embodiment of the hand tool.

FIGS. 10–12 illustrate an alternative connection between the trigger handle 24 and the support assembly 18. In the embodiment of FIGS. 10 and 11, sides 21 and 23 of the trigger handle are provided with channels 55 extending from an exterior of the rear end 40 into the body of the trigger. The intermediate member 47 or any other suitable part of the support assembly is provided with projections 53 which are adapted to be received within the channels 55. FIG. 12 shows the connection between the trigger handle and the support assembly in which the channels 55 are situated in the intermediate member 47 or any suitable part of the support assembly and the protrusions 53 extend from inside surfaces of the sides 21 and 23.

In the standby condition of the hand tool (see FIG. 10), the rear end 40 of the trigger handle engages the limit stop 42, the driving lever 32 and extension 15 of a connecting element 13. Compression of the spring 36 urges the driving lever 32 and the trigger handle against the stop 42. The above discussed engagement between the protrusions and channels ensures proper pivotal connection between the trigger handle and the support assembly.

The arrangement illustrated in FIGS. 10–12 facilitates the process of assembly of the hand tool in general and specifically simplifies positioning of the trigger handle within the tool.

The slide bar 14 passes through opening 48 in the braking lever 46. One end 50 of the braking lever 46 is pivotably positioned in a recess 52 such that the braking lever 46 may pivot within constraints defined by the surfaces of the recess 52 and by binding of the braking lever 46 with the slide bar 14 when the edges of the opening 48 in the lever 46 engage the end surfaces of the slide rod 14. As best illustrated in FIG. 1 the recess 52 is situated in the vicinity of the junction between the front portion 41 and the fixed jaw 22. At least one compression spring 54 is seated in a recess 56 in the body 19 and biases the free end of the braking lever 46 away from the front portion 41. The biased position of the braking lever 46 is limited by the binding and/or cocking interference between the opening 48 of the lever 46 and the end surfaces of the slide bar 14.

In the embodiment illustrated in FIG. 1 the braking lever 46 extends in one direction of the handgrip from the recess 52, so that its first end or engaging portion 33 is remote from the recess and is suitably gripped by the thumb of the user.

Figure 5:
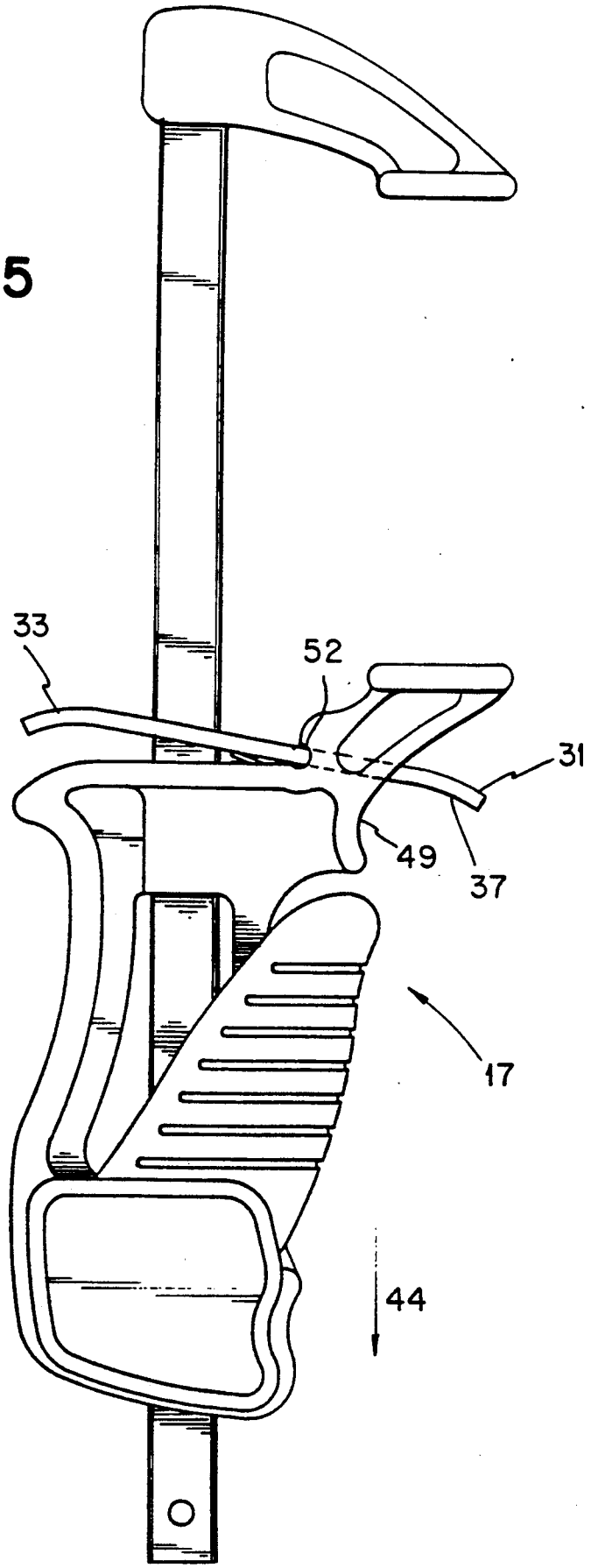
FIG. 5 is an elevational view showing another embodiment of the hand tool.

An alternative embodiment is shown in FIG. 5. There, the braking lever extends from the recess 52 in both directions. A second end 31 of the braking lever opposite to the end 33 passes through the body 19 of the support assembly and protrudes outwardly defining an engaging surface 37 for activation by the index finger of the user. If desired, both embodiments as shown in FIG. 5 may be present and one can use either as is convenient or the bar clamp may utilize one alternative. Note that in one case, the thumb is pressing down on the braking lever, and in the other case, the index finger is pressing it up.

It should be noted that in the standby position illustrated in FIG. 1, the driving lever 32 is substantially perpendicular to the longitudinal axis A-A of the slide bar 14, whereas the portion of the braking lever 46 which engages the slide bar 14 is transversely oriented to the longitudinal axis of the bar 14 at a slight angle. In this condition, if a force is applied to the moving jaw 12 in the direction indicated by the arrow 44, the slide bar 14 is free to move through all the openings of the support assembly 18. Because the braking lever 46 is free to pivot against the bias of the spring 54 when force is applied on the moving jaw 12 in the direction of the arrow 44, the braking lever 46 presents no obstacle to this motion of the slide bar and the moving jaw 12 may be advanced continuously toward the fixed jaw 22.

However, in the standby position as illustrated in FIG. 1, if a force is applied to the movable jaw 12 in the direction opposite to the direction indicated by the arrow 44, the end edges of the opening 48 in the lever 46 bind against the end surfaces of the slide bar 14 and it is not possible to withdraw the moving jaw further away from the fixed jaw 22. Compression of the spring 54 by pressing on the braking lever 46 with a finger in the direction of the arrow 44, allows withdrawal of the slide bar 14 and its movable jaw 12 to be extended away from the fixed jaw 22. Compression of the spring 54 brings the end 33 of the lever 4 into perpendicularity with the direction of intended motion of the slide bar 14, and thus the slide bar 14 is then free to slide in either direction through the opening 48 in the braking lever 46.

The trigger handle 24 is squeezed in the direction indicated by the arrow 17 (toward the slide bar) to incrementally advance the slide bar 14 with the movable jaw 12 toward the fixed jaw 22. When the trigger handle 24 is squeezed between a user's hand (not shown) and the handgrip 20, pivoting occurs about the pivot pin 26 and the rear end 40 of the trigger handle 24 also pivots and moves substantially in the direction of the arrow 44. This causes the driving lever 32 to pivot about its first end 35, so that the driving lever 32 is no longer perpendicular to the direction 44 of intended motion of the slide bar 14. Pivoting the driving lever 32 compresses the spring 36 and also causes the end edges of the hole 34 through the driving lever 32 to bind against the end surfaces of the slide rod 14. Binding occurs because the driving lever 32 is no longer perpendicular to the direction 44 of intended motion of the slide bar 14. Further motion of the trigger handle 24 causes the driving lever 32 to translate in the direction of the arrow 44. This motion further compresses the spring 36 and in the process, by means of the binding and/or cocking interference between the lever 32 and bar 14, advances the bar 14 and its connected movable jaw 12 towards the fixed jaw 22. The maximum distance of advance of the movable jaw 12 with one stroke of the trigger handle 22 is limited where the spring 36 is fully compressed or the handle 24 strikes the inner surface 58 of the body 19.

However, the stroke of the trigger handle 24 can be through any lesser arc, thereby diminishing the distance the movable jaw 12 travels in a single stroke in proportion to the angle of the trigger handle stroke. Additional strokes may be applied to the trigger handle 42 of any magnitude until the jaws 12, 22 come together, or a workpiece (not shown) is firmly gripped between them.

After the trigger handle 24 is fully pivoted in the direction of the arrow 17 about the pivot pin 26, release of the trigger handle 24 causes the return of the trigger handle 24, driving lever 32 and spring 36 to the position shown in FIG. 1 as a result of the compressive forces in the spring 36 urging the components toward the movable jaw 12.

A transverse pin or a stop 60 passing through the free end of the slide bar 14 prevents withdrawal of the slide bar 14 from the slot 16 when the braking lever 46 is pressed in the direction of the arrow 44 and the movable jaw 12 is manually drawn away from the fixed jaw 22. It should be noted that operation of the trigger handle 24 is ineffective in accomplishing any motion of the slide bar 14 in the direction opposite to the arrow 44.

Protective pads and/or specialty pads (not shown) can be attached to the jaws 12 and 22. The moving jaw 12 is held to the slide bar 14 by any conventional means, such as press fit, welding, rivet or pin, adhesives, etc. In the illustrated embodiment (FIG. 1) in accordance with the invention, the slide bar 14 has a rectangular cross-section. In alternative embodiments in accordance with the invention, the slide bar 14 may be any shape, for example, square, round, triangular, and the openings 34, 48 in the levers 32, 46, respectively as well as the openings 25, 27 and 29 of the support assembly would be appropriately shaped for their respective proper binding interference and alignment with the slide bar 14.

In summary, if it is desired that a workpiece is to be held between the jaws 12, 22, the movable jaw 12 can be advanced toward the fixed jaw 26 reducing a gap therebetween either in one continuous motion, merely by pushing in the direction of the arrow 44 on the movable jaw 22 or, by operating the trigger handle 24 in a series of strokes of length to be determined by the user. Large strokes may be used at first and small strokes later as the desired pressure is applied to the workpiece. During this advancing operation, the braking lever 46 prevents any backward motion (in the direction opposite to the arrow 44) of the slide bar 14 after each advance has been completed. While the braking lever 46 holds the bar 14, the trigger handle 24 is released. The spring 36 then returns the handle 24 and driving lever 32 to the positions shown in FIG. 1, ready for another stroke. At any time when the user desires to retract the movable jaw 12 away from the fixed jaw 22, for example, to release a workpiece or to open the bar clamp to receive a workpiece, it is only necessary to pull the movable jaw 12 in the direction opposite to the arrow 44 while simultaneously compressing the spring 54 by pressing on the first engaging part 33 of the braking lever 46 in the direction of the arrow 44.

It should be noted that the operation of the trigger handle 24 and braking lever 46 can be accomplished by the same hand while holding the bar clamp 10 with that hand.

In the preferred embodiment illustrated in FIG. 1 the thumb is typically positioned on the first end or engaging part 33 of braking lever 46, the other fingers encircle the trigger handle 24 while the handle 20 is contained by the palm of the same hand.

For general handling and holding of the hand tool, where one does not desire to hold-activate the trigger which could lead to inadvertent actuation and advancement of the movable jaw 12, first 49 and second 61 engagement areas are provided for one's fingers.

The embodiment shown in FIG. 5 can be operated as described hereinabove. However, when necessary the second end 31 with the engaging part 37 can be used. In such situation, to accomplish one hand operation, the index finger is positioned within the first engaging area 49 to actuate the braking lever 46 by pressing the second engaging part 37 in the direction opposite to the arrow 44. The other fingers encircle the trigger handle 24 while the handgrip 20 is contained in the palm of that hand.

As best illustrated in FIGS. 1–12, the overall quick action bar clamp 10 in accordance with the invention is basically flat, takes little space, and can be operated in tight places. Slide bars 14 of different lengths may be used.

Figure 6:
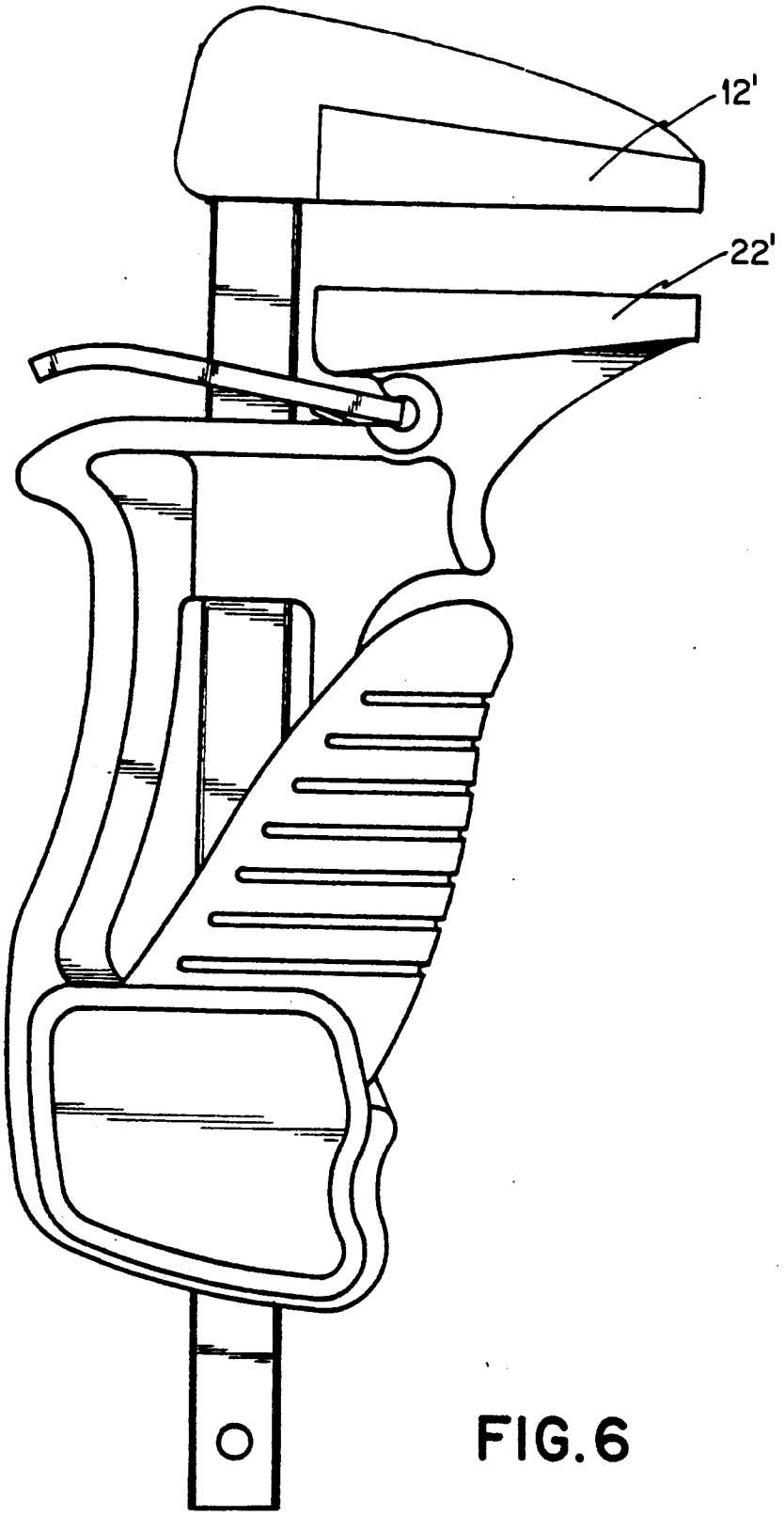
FIG. 6 is an elevational view of a further embodiment of the hand tool.

Grip of a workpiece by the jaws is quite strong so the hand tool of the invention can be used as a wrench. In this and other applications, in order to provide additional engagement with a workpiece, engaging surfaces of the movable jaw 12' and fixed jaw 22' can be extended as best shown in FIG. 6.

When the hand tool is used as a wrench, after a workpiece such as a nut, bolt, etc., is set between the jaws, a torque rotating the workpiece is applied by a user to the support assembly.

Figure 7:
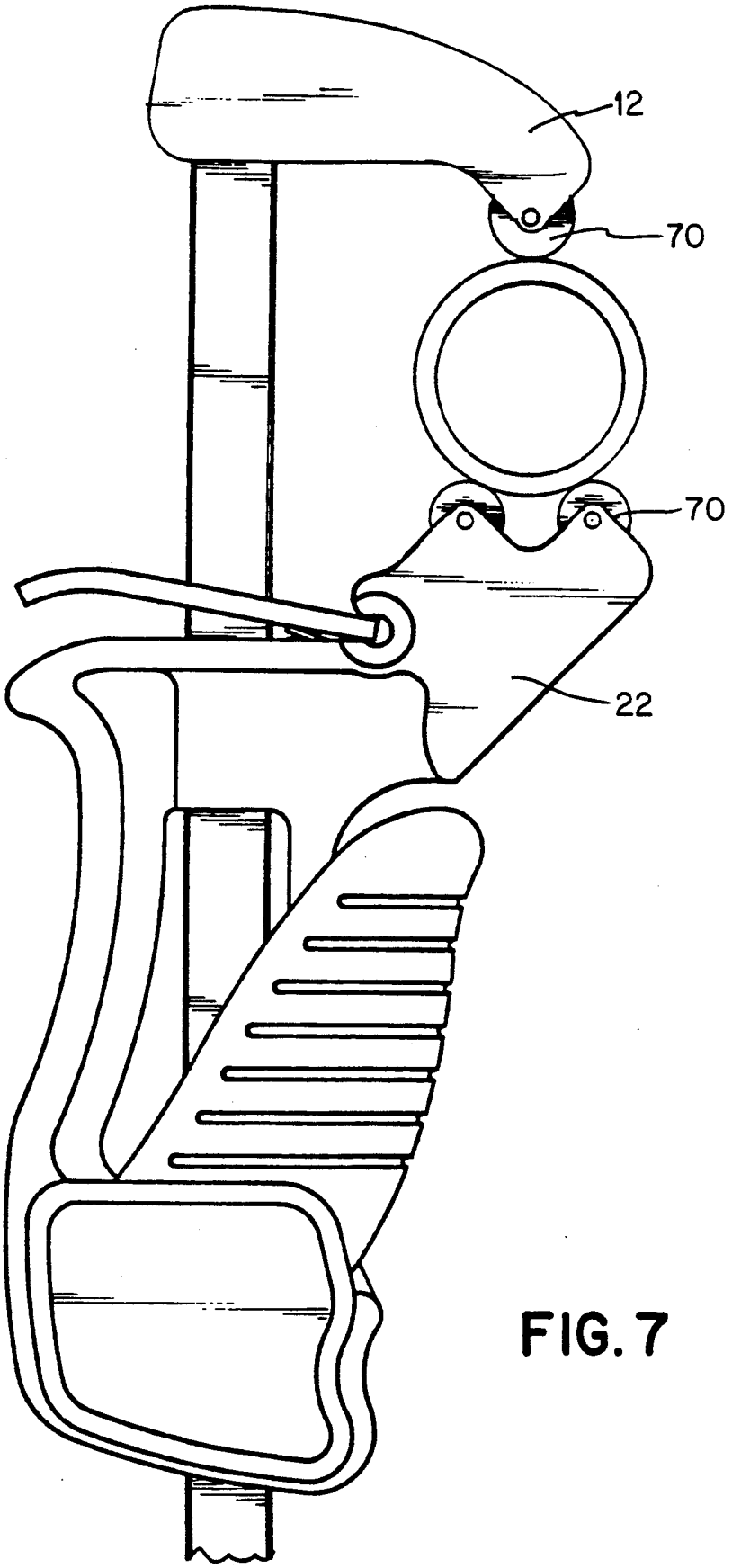
FIG. 7 is an elevational view of the hand tool used as a cutter.

FIG. 7 illustrates an embodiment of the invention adapted for use as a cutter. For this purpose, a plurality of cutting members is mounted on the jaws as shown, or alternatively a single cutter may be employed opposite a pair of rollers (not shown).

In the embodiment of the cutter shown in FIG. 7, one substantially circular cutting element 70 is rotatably mounted to the movable jaw 12 and two similar cutting elements are mounted to the fixed jaw 22.

Figure 8:
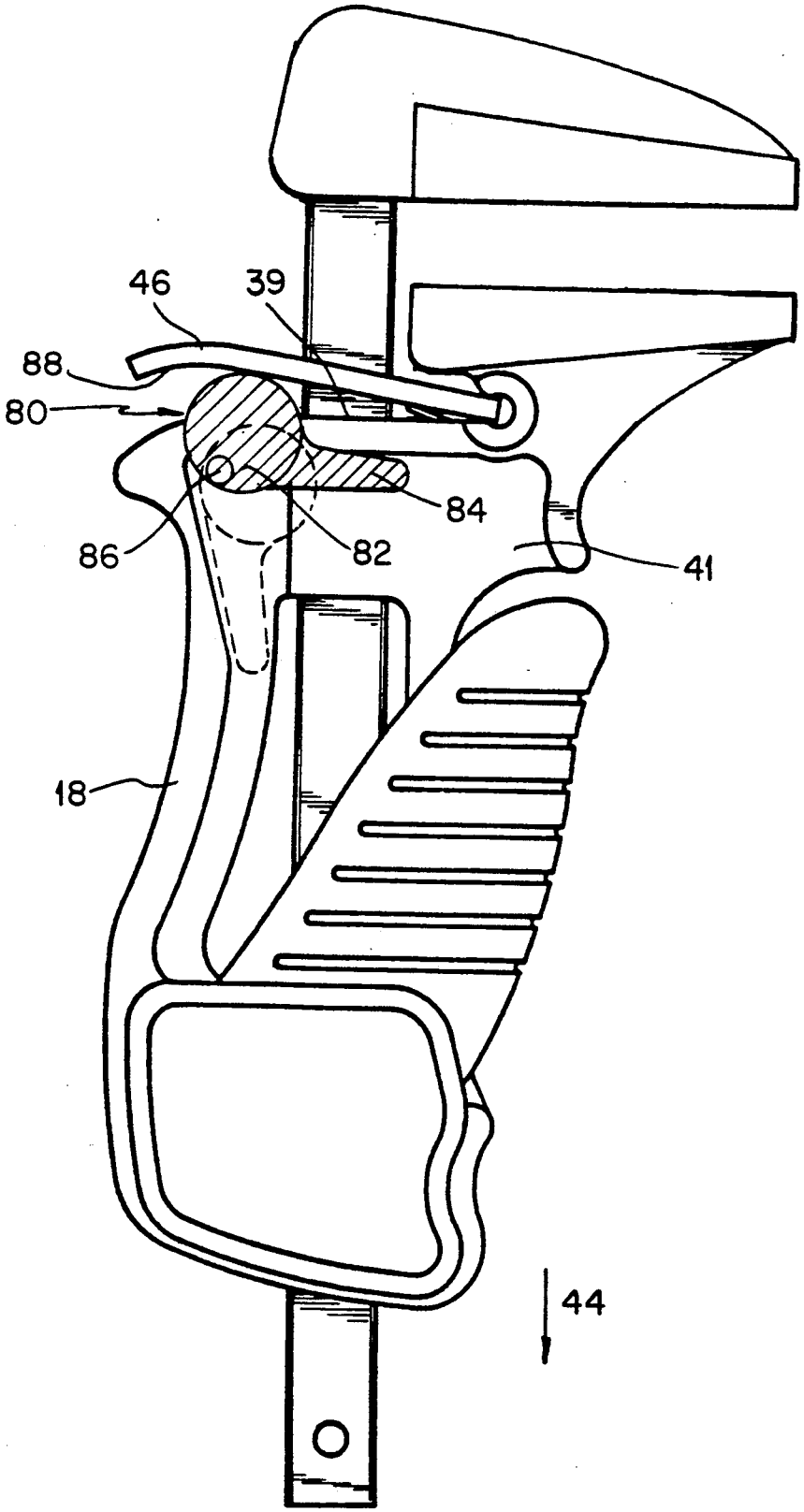
FIG. 8 is a view of the hand tool showing a locking mechanism.

In order to avoid inadvertent actuation of the braking lever, suitable locking means or a locking mechanism (as best illustrated in FIG. 8) can be provided at the support assembly 18. This mechanism consists of a cam 82 concentrically rotated about an axial pin 86. A handle part 84 extends outwardly from the cam and facilitates its rotation.

In the locked position of the mechanism, illustrated by solid lines in FIG. 8, the cam 82 protrudes beyond an outside surface 39 of the front part 41 of the support assembly and engages inside surface 88 of the braking lever 46. Such engagement prevents the braking lever from being inadvertently activated by pressing it in the direction of the arrow 44.

In the unlocked condition which is shown in FIG. 8 by phantom lines, the cam 82 does not extend beyond the surface 39 in the direction opposite to that of the arrow 44. Therefore, there is no obstacle for the braking lever to travel when it is pressed by fingers of a user.

In the embodiment of FIG. 1 the movable jaw 12 and the fixed jaw 22 are positioned on one side of the support assembly 18 and face each other. Therefore, activation of the driving lever 32 by the trigger handle 24 moves the slide bar 14 and the jaw 12 in the direction of the fixed jaw.

Figure 9:
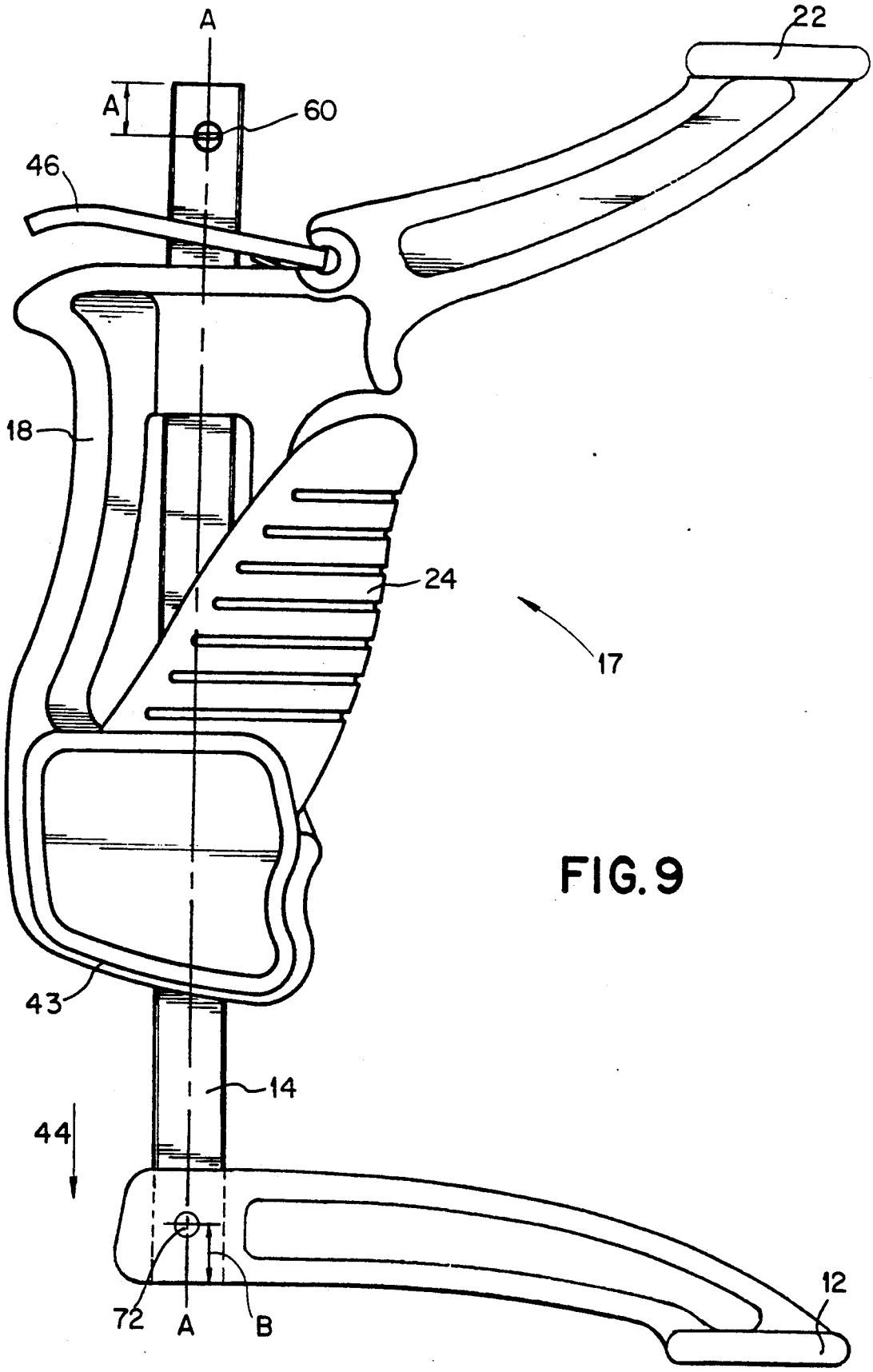
FIG. 9 is an elevational view of still another embodiment of the hand tool.

A modified hand tool having the fixed jaw 22 and movable jaw 12 facing in opposite directions and extending from opposite sides of the support assembly 18 is best shown in FIG. 9. In this embodiment the slide bar is inserted into the support assembly in such a way that the stop 60 positioned at one end thereof faces the braking lever 46 and the movable jaw 12 positioned at the other end of the slide bar faces the rear portion 43 of the support assembly.

In operation of this embodiment, when the trigger handle 24 is squeezed in the direction of the arrow 17 (toward the slide bar) it activates the driving lever (not shown in FIG. 9) and incrementally advances the movable jaw 12 connected to the slide bar 14 away from the fixed jaw 22.

In the standby position, shown in FIG. 9, the braking lever 46 engaging the slide bar 14 is transversely oriented to the longitudinal axis A—A at a slight angle. If a force is applied to the movable jaw in the direction of the arrow 44, the braking lever 46 presents no obstacle to the motion of the slide bar. However, if a force is applied to the movable jaw 12 in the direction opposite to the direction of the arrow 44, the engagement of the lever 46 and the surfaces of the slide bar 14 makes it impossible to withdraw the movable jaw 12 further away from the fixed jaw 22.

If it is desired that a workpiece is to be spread apart by the jaws 12 and 22, the movable jaw 12 is advanced away from the jaw 22 by activation of the trigger handle and driving lever.

Typically, the movable jaw is permanently mounted at one end of the slide bar, whereas the stop is fixedly positioned at the other end. However, if desired the movable jaw 12 can be connected to the slide bar by means of a screw 72 or by any other suitable fastening means. The stop 60 can also be attached to the slide bar by a thread or any other conventional means to facilitate its removal and/or replacement.

In this case, the hand tool shown in FIG. 1 having jaws facing each other can easily be converted into the hand tool illustrated in the embodiment of FIG. 9 with the jaws facing in opposite directions.

In order to convert the tool, the screw connecting the movable jaw to the slide bar is loosened and the jaw removed from the bar.

Then, the stop is likewise released and taken out. The movable jaw 12 is then positioned on the bar as illustrated in FIG. 9 and the screw 72 tightened into the threaded opening in the slide bar to ensure permanent fixation. The stop 60 is then threaded into an opening in the slide bar facing the braking lever. In this case, the threads of the openings in the slide bar which are adapted for the attachment of the removable jaw 12 and the stop 60 are compatible and generally positioned at equal distances (A and B) from the corresponding ends of the slide bar.

A further embodiment of the present invention comprises a substrate mounted hand tool which can function as a vise to grip or clamp a wide variety of workpieces which are supportable on a substrate.

Figures 13, 13A, 15:
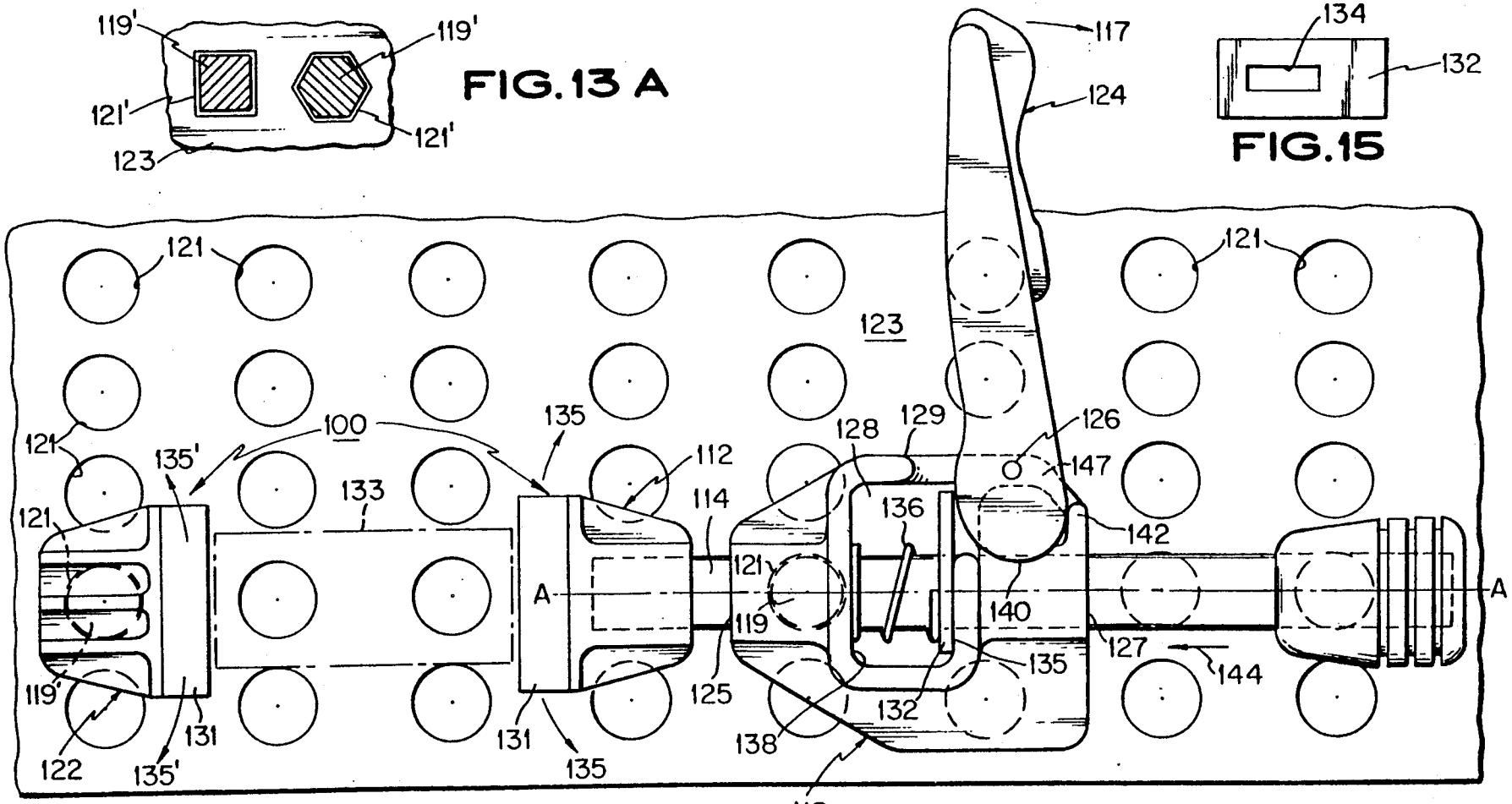
FIG. 13 is a plan view of a substrate mounted hand tool in its open position.
FIG. 15 is a plan view of the driving lever of the substrate mounted hand tool of FIG. 13.
Figure 14:
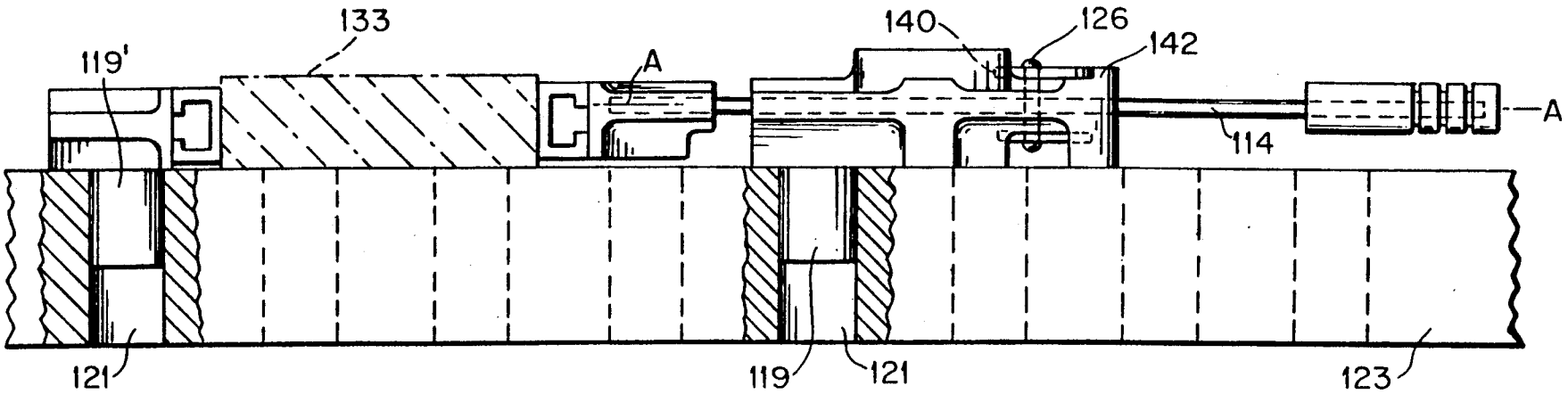
FIG. 14 is a side elevational view of the substrate mounted hand tool of FIG. 13.
Figure 17:
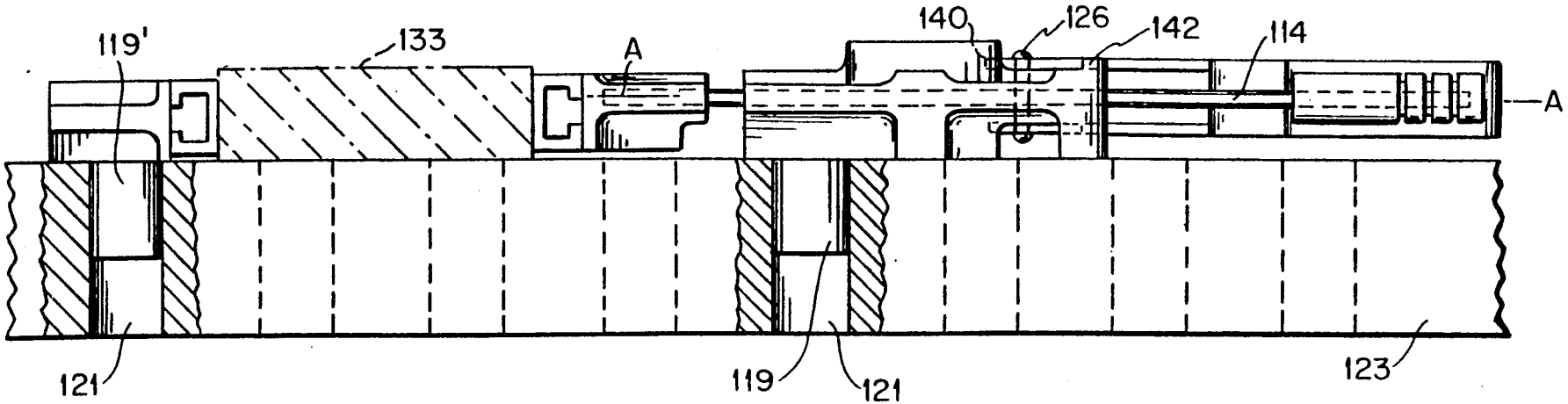
FIG. 17 is a side elevational view of the substrate mounted hand tool of FIG. 16.
Figure 18:
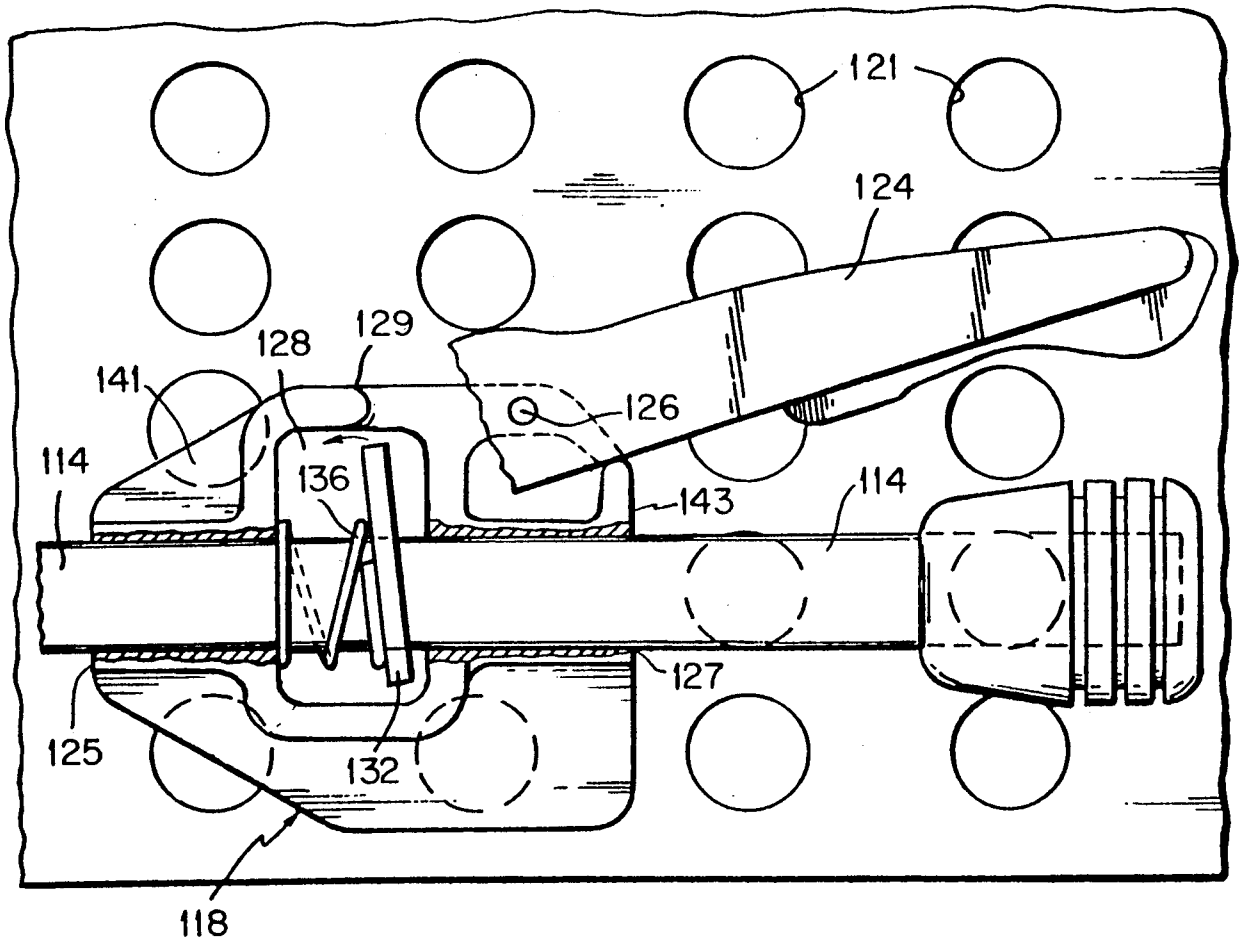
FIG. 18 is a partially sectional view of the support assembly of the substrate mounted hand tool of FIG. 13.
Figure 19:
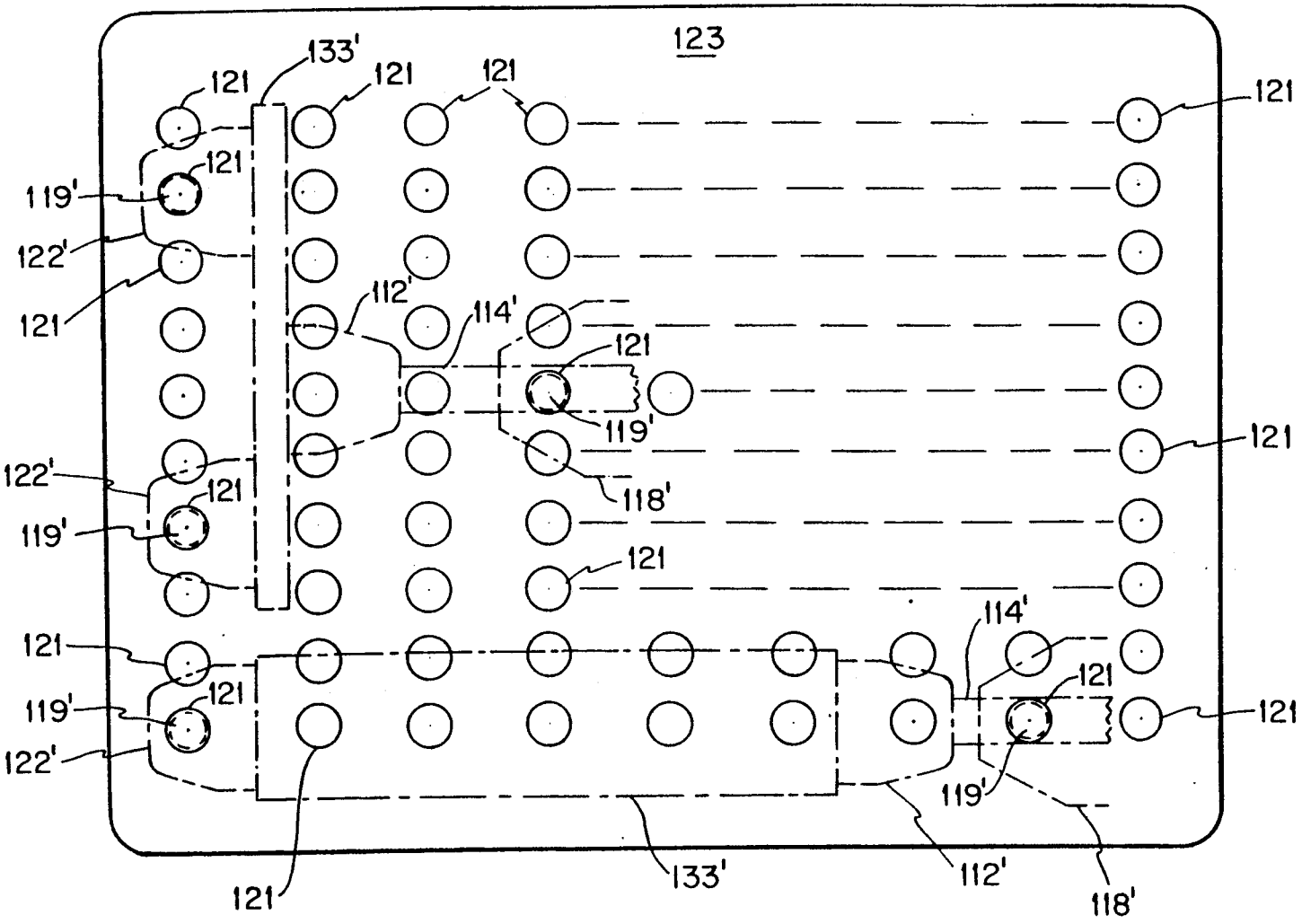
FIG. 19 is a plan view of a substrate showing different sized workpieces being held by the substrate mounted hand tool of FIG. 13.

Referring now to FIGS. 13, 14 and 18, the substrate mounted hand tool or improved vise clamp of the invention is shown at 100 and includes a movable jaw 112 mounted to a slide bar 114. The slide bar 114 is movable within openings 125 and 127 of a support assembly or support means 118. Support means 118 has a mounting post 119 affixed thereto and mounting post 119 is snugly fitted into aperture 121 of substrate 123 which is suitably made of wood or a strong plastic and is provided with a plurality of apertures 121 of the same size and shape. In the FIGS. 13, 14, 18, post 119 is cylindrical in shape as is aperture 121, and support means 118, and hence movable jaw 112, can therefore be rotated as indicated at 135 upon rotation of post 119 in aperture 121. Other suitable shapes for the mounting posts and apertures are rectangular and polygonal as shown in FIG. 3(A). A stationary jaw 122 opposing the movable jaw 112 is mounted on substrate 123 by means of a mounting post 119′ affixed thereto which snugly fits into an aperture 121 and is rotatable therein as indicated at 135′ in the same manner as support means 118. A workpiece is shown at 133 between stationary jaw 122 and movable jaw 112. Support means 118 and stationary jaw 122 can be positioned in the various apertures 121 of substrate 123 and suitably rotated as required to accommodate workpieces 133′ of different sizes and shapes which are supported on substrate 123 and illustrated in FIG. 19. Jaws 112 and 122 can be provided with slightly compressible, resilient and removable pads 131 suitably made from conventional commercially available materials. As shown in FIG. 19, more than one stationary jaw 122′ can be used in combination with a movable jaw 112′. The support assembly 118 which is more specifically shown in FIG. 18 has a body 129 with front 141 and rear 143 portions.

FIGS. 13 and 14 illustrate that the longitudinal axis A—A of the slide bar 114 is substantially parallel to substrate 123 and/or coincides with the longitudinal axes of the openings 125 and 127. The motion of the slide bar is supported by the surfaces of the two openings 125, 127, in the front and rear portions of the support assembly 118. Such multiple support of the slide bar greatly enhances stability of the clamping operation.

A longitudinally extending clamping handle 124 is pivotably mounted to the support assembly 118 by means of a pivot pin or connection 126 and is shown in the open position in FIG. 13. For illustrative purposes this pivotal connection is shown to be positioned in the vicinity of the cavity 128.

Figure 16:
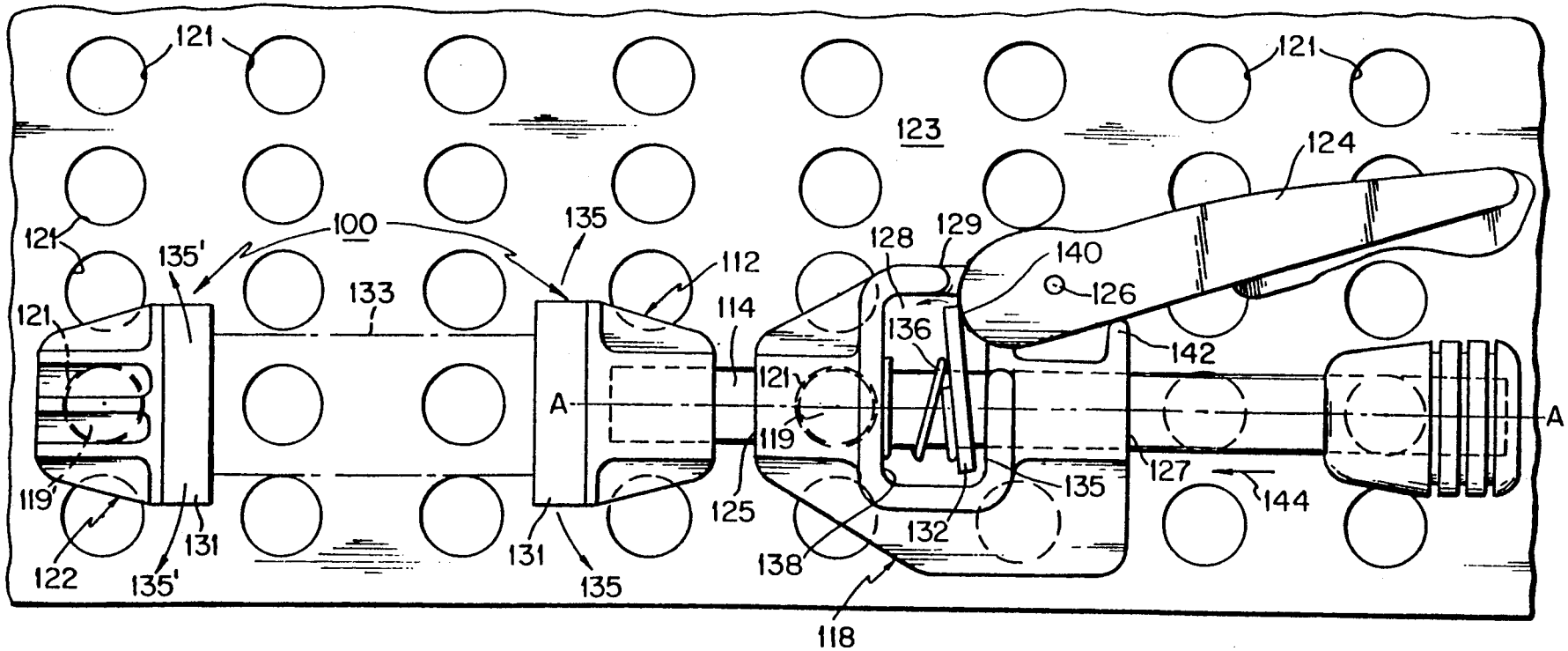
FIG. 16 is a plan view of the substrate mounted hand tool of FIG. 13 in its closed position.

As a result of pivotal motion of clamping handle 124 to the closed position of FIG. 16, at least a part of the handle 124 extends into cavity 128 of the support assembly 118. The cavity 128 is limited by the front portion 141 and the rear portion 143. In FIG. 13, longitudinally extending clamping handle 124 is in its open position transverse to the longitudinal axis A—A of slide bar 114 and driving lever 132 is released from slide bar 114.

Driving lever 132 is located and/or suspended on the slide bar 114 which passes through a hole 134 in the driving lever 132. A compression spring 136 between the driving lever 132 and a surface 138 of the cavity 128 urges the driving lever 132 against the cam-shaped end 140 of the clamping handle 124. At least the cam-shaped end 140 of the clamping handle 124 is suitably in the form of a fork so as to straddle the rib 147 of body 129 and the slide bar 114. Force of the spring 136 presses against driving lever 132 which in turn presses against cam-shaped surface 140, thus providing a standby condition with driving lever 132 released from slide bar 114 and clamping handle 124 substantially transverse to slide bar 114. In the standby or open condition of FIG. 13, the driving lever 132 is positioned substantially perpendicular to the direction of motion, indicated by the arrow 144, of the slide bar 114 when in operation. Motion of the clamping handle 124 about the pivot pin 126 in the direction of an arrow 117 to the closed position of FIG. 16 moves the slide bar 114 against the bias of the spring 136 as hereinafter described.

In the open or standby position illustrated in FIG. 13 and described above, the driving lever 132 is substantially transverse to the longitudinal axis A—A of the slide bar 114 and driving lever 132 is released from slide bar 114. In this condition, if a force is applied to the movable jaw 112 in the direction indicated by the arrow 144 (and also in the opposite direction), the slide bar 114 is free to move through all the openings of the support assembly 118 and the movable jaw 112 can advance to contact workpiece 133 which abuts stationary clamp 122.

In rotating clamping handle 124 to the closed, or clamped position as illustrated in FIG. 16, the movement of cam-shaped portion 140 of clamping handle 124 causes driving lever 132 to pivot about its end 135 and lever 132 is no longer perpendicular to slide rod 114 and binds against the end edges of slide rod 114 and advances the movable jaw 112 against workpiece 133. If a force is applied to the movable jaw 112 in the direction opposite to the direction indicated by the arrow 144, the end edges of the opening 134 in the driving lever 132 bind against the end surfaces of the slide bar 114 and it is not possible to withdraw the movable jaw 112 further away from the stationary jaw 122 and workpiece 133 is securely held in place.

Rotation of the clamping handle 124 in the direction indicated by the arrow 117 (toward the slide bar 114), advances the slide bar 114 with the movable jaw 112 toward the stationary jaw 122. When the clamping handle 124 is rotated as above-described, pivoting thereof occurs about the pivot pin 126 which cause the driving lever 132 to pivot about its first end 135, so that the driving lever 132 is no longer perpendicular to the direction 144 of intended motion of the slide bar 114. Pivoting the driving lever 132 as described compresses the spring 136 and also causes the end edges of the hole 134 through the driving lever 132 to bind against the end surfaces of the slide rod 114. Binding occurs because the driving lever 132 is no longer perpendicular to the direction 144 of intended motion of the slide bar 114 as previously described. The maximum distance of advance of the movable jaw 112 with rotation of the clamping handle 124 is limited when the spring 136 is fully compressed or the clamping handle 24 strikes limit stop 142.

After the clamping handle 124 is fully pivoted in the direction of the arrow 117 about the pivot pin 126 to the position of FIG. 16, release of the clamping handle 124 by rotation opposite to direction 117 causes the return of the clamping handle 124, driving lever 132 and spring 136 to the open position shown in FIG. 13 as a result of the compressive forces in the spring 136 urging the components away from the movable jaw 112, thus resulting in the aforementioned open or standby position.

Figure 20:
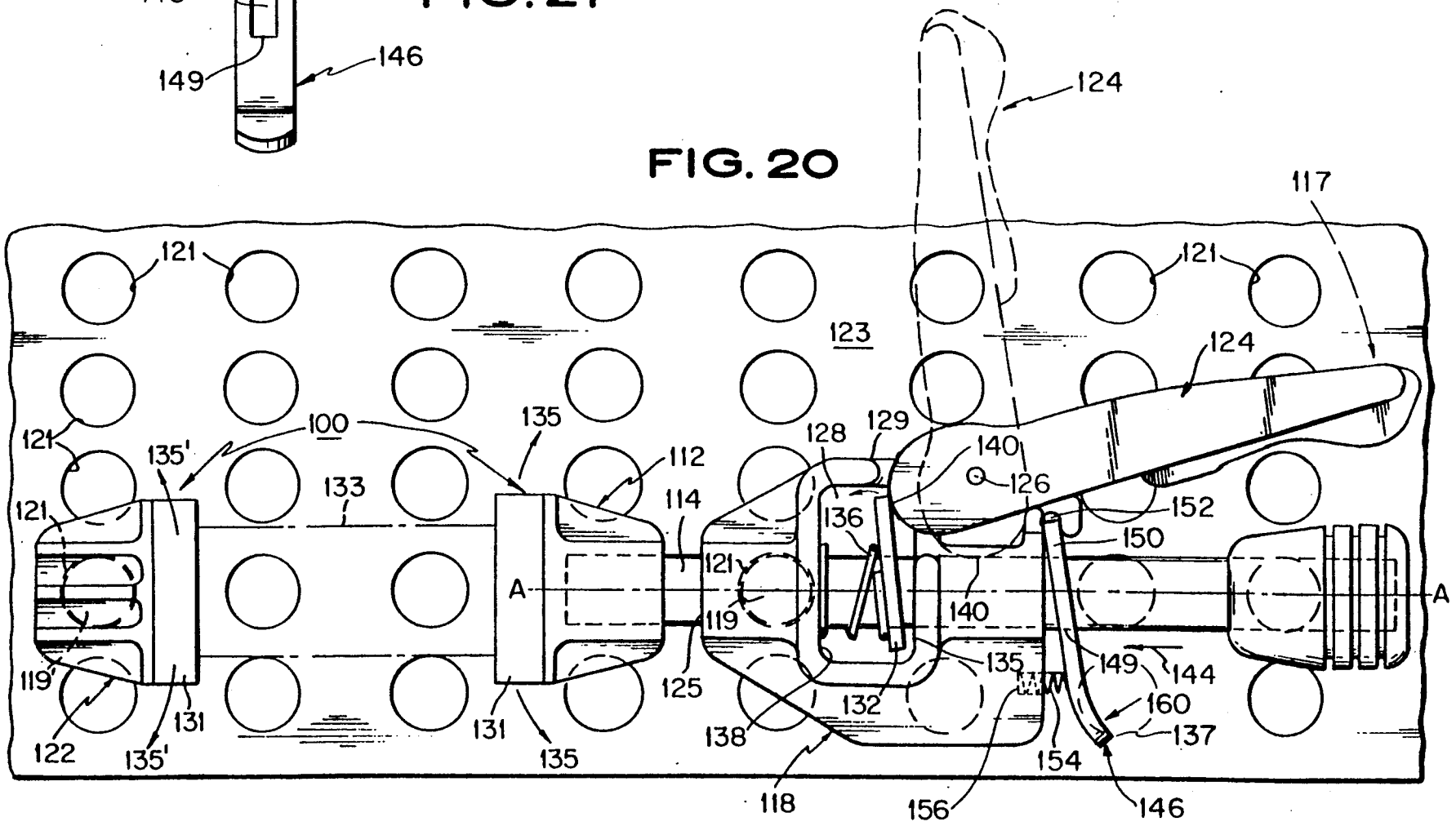
FIG. 20 is a side elevational view of a modification of the hand tool of FIG. 13.
Figure 21:
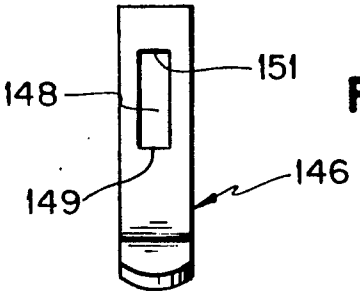
FIG. 21 is a plan view of an element of the modification of FIG. 20.

The arrangement illustrated in FIGS. 20–21 facilitates the operation of the hand tool by holding movable jaw 112 and slide rod 114 in place after clamping is achieved by each pivotal rotation of clamping handle 124 even when clamping handle 124 has been rotated to its open position transverse to slide rod 114. Thus, the bar 114 along with the movable jaw 112 will advance in an incremental step for each complete stroke or movement of handle 124 from the open position to the closed position as illustrated in FIG. 20.

In the open clamping position (shown in dotted lines in FIG. 20) slide bar 114 remains engaged with release tab 146 until such tab 146 is moved from its slightly angled position shown in FIG. 20 in the direction 160 to a position perpendicular to slide rod 114 as hereinafter described.

In the closed clamping position of FIG. 20, the slide bar 114 passes freely in direction 144 through opening 148 in the release tab 146 but not in the opposite direction due to binding of the release tab 146 in the slide bar 114. One end 150 of the release tab 146 is pivotably positioned in a recess 152 such that the release tab 146 may pivot within constraints defined by the surfaces of the recess 152 and by binding of the release tab 146 with the slide bar 114 when the edges of the opening 148 in the release tab 146 engage the end surfaces of the slide rod 114. As illustrated in FIG. 20 the recess 152 is situated in the support means 118 remote from the movable jaw 112 and adjacent stop 142. At least one compression spring 154 is seated in a recess 156 in the body 118 and biases the free end of the release tab 146 toward the rear portion 143 to engage slide bar 114. The biased position of the release tab 146 is limited by the binding and/or cocking interference between the upper and lower portions 151 and 149 of opening 148 of the release tab 146 and the end surfaces of the slide bar 114.

In the embodiment illustrated in FIG. 20 the release tab 146 extends away from the recess 152, so that its first end or engaging portion 137 is remote from the recess 152 and can be readily depressed by finger pressure in direction 160.

In the closed position illustrated in FIG. 20, the movable jaw 112 is located adjacent to workpiece 133'' and the driving lever 132 is at a slight angle to the longitudinal axis A—A of slide bar 114 such that a force applied in the direction of arrow 144 will advance slide bar 114, but for a force in the opposite direction, the end edges of the opening 134 in the driving lever 132 bind against the end surfaces of the slide bar 114 and restrain movement thereof as hereinabove described. For the open position of clamping handle 124 (shown in dotted lines in FIG. 20), the release tab 146 engages the slide bar 114 in the slightly angled position shown, but when moved by finger pressure in the rotational direction of arrow 160, against the bias of spring 154, the upper end edge 151 and lower end edge 149 of opening 148 of release tab 146 disengage from the end surfaces of slide bar 114 and the slide bar 114 with movable jaw 112 can be moved toward and away from the stationary jaw 122 and workpiece 133'. Removing pressure from release tab 146 causes tab 146 to be returned by compressed spring 154 to its initial slightly angled position to bind against the end surfaces of slide bar 114.

What is claimed is:

1. A substrate mounted hand tool comprising:

a substrate member having a substantially planar surface;

a stationary jaw positioned on said substrate surface and removably engaged to said substrate;

a movable jaw;

a slide bar, said movable jaw being mounted to said slide bar;

support means for supporting said slide bar positioned adjacent to said substrate and removably engaged to said substrate; said stationary jaw being spaced away from said support means and facing said movable jaw;

one-way drive means for releasably engaging and, when engaged, for advancing said slide bar and said movable jaw to an advanced position and holding said movable jaw in said advanced position, said one-way drive means having at least a driving lever; and a longitudinally extending clamping handle pivotably mounted at said support means and contacting said driving lever and extending transverse to said slide bar when said one-way drive means is released from said slide bar and extending generally parallel to said slide bar to cause said one-way drive means to be engaged with said slide bar.

2. Apparatus in accordance with claim 1 having receiving means in said support means spaced from said one-way drive means, a release tab pivotable at said receiving means and having an engaging portion adjacent to said slide bar extending outwardly from said support means and away from said clamping handle for releasably engaging said slide bar.

3. Apparatus in accordance with claim 1 wherein said stationary jaw and said support means are provided with respective mounting posts of essentially the same cross-section and said substrate is provided at its planar surface with a plurality of apertures of the same but slightly larger cross-section than that of the posts, said mounting posts being inserted in separate apertures of said substrate and being removably engaged therewith.

4. Apparatus in accordance with claim 1 wherein said stationary jaw and said support means are provided with respective mounting posts of essentially the same circular cross-section and said substrate is provided at its planar surface with a plurality of apertures of the circular cross-section slightly larger than the cross-section of the posts, said mounting posts being inserted in separate apertures of said substrate and being rotatably engaged therewith.

5. Apparatus in accordance with claim 3 wherein the mounting post of said support means extends transverse to the said slide bar.

6. Apparatus in accordance with claim 1 wherein said substrate is provided with a plurality of apertures and said support means is provided with a mounting post for removably engaging an aperture of said substrate.

7. A substrate mounted hand tool comprising:

a substrate member having a substantially planar surface with a plurality of apertures;

a stationary jaw having a mounting post positioned on said substrate surface and removably engaged to said substrate by way of said mounting post;

a movable jaw;

a slide bar, said movable jaw being mounted on one end of said slide bar, said slide bar being slidably movable to bring said movable jaw toward and away from said stationary jaw;

support means for slidably supporting said slide bar, said stationary jaw being spaced away from said support means and positioned opposite said movable jaw;

a mounting post of circular cross-section affixed to said support means for removably engaging said substrate at one of said apertures;

one-way drive means for releasably engaging and, when engaged, for advancing said slide bar and attached movable jaw to an advanced position and holding said movable jaw in said advanced position, said one-way drive means having a driving lever, and a release tab lever releasably engaged to said slide bar to restrain movement of said slide bar away from said stationary jaw;

a longitudinally extending handle pivotably mounted to said support means and contacting said driving lever and extending transverse to said slide bar when said one-way drive means is released from said slide bar and extending generally parallel to said slide bar to cause said one-way drive means to be engaged with said slide bar, whereby pivotal motion of said longitudinally extending handle toward said slide bar results in said driving lever engaging and moving said slide rod and said movable jaw toward said stationary jaw.

8. A hand tool comprising:

a movable jaw;

a slide bar, said movable jaw being mounted to said slide bar;

support means for supporting said slide bar; adapted to removably engage a substrate;

one-way drive means for releasably engaging and, when engaged, for advancing said slide bar and said movable jaw to an advanced position and holding said movable jaw in said advanced position, said one-way drive means having at least a driving lever; and a longitudinally extending clamping handle pivotably mounted at said support means and contacting said driving lever and extending transverse to said slide bar when said one-way drive means is released from said slide bar and extending generally parallel to said slide bar to cause said one-way drive means to be engaged with said slide bar.

9. Apparatus in accordance with claim 8 having receiving means in said support means spaced from said one-way drive means, a release tab pivotable at said receiving means and having an engaging portion adjacent to said slide bar extending outwardly from said support means and away from said clamping handle for releasably engaging said slide bar.

10. Apparatus in accordance with claim 8 wherein said support means is provided with a respective mounting post of circular cross-section.

11. Apparatus in accordance with claim 8 wherein the mounting post of said support means extends transverse to the said slide bar.

* * * * *